US005082018A

United States Patent [19]

Caswell et al.

[11] Patent Number: 5,082,018

[45] Date of Patent: Jan. 21, 1992

[54] SYSTEM FOR PREVENTING LOSS OF WATER FROM THE WATER LINE OF A BUILDING

[76] Inventors: Frederick A. Caswell, 337 La Tierra Buena, Danville, Calif. 94526; Oscar O. Caswell, 16632 Hannah Dr., San Lenadro, Calif. 94578

[21] Appl. No.: 653,355

[22] Filed: Feb. 11, 1991

[51] Int. Cl.[5] ..... F16L 5/00

[52] U.S. Cl. ..... 137/357; 137/434; 137/883

[58] Field of Search ..... 137/356, 357, 883, 434

[56] References Cited

U.S. PATENT DOCUMENTS 1,526,718 2/1925 Opp ..... 137/357
2,931,382 4/1960 Cirillo ..... 137/357
3,028,966 4/1962 Wiesmann ..... 137/357
4,848,389 7/1989 Pirkle ..... 137/357

*Primary Examiner*—A. Michael Chambers
*Attorney, Agent, or Firm*—Thomas R. Lampe

[57] ABSTRACT

A one-way check valve is positioned in a water line leading from a building to a water supply line or main so that the water line is divided into a first portion substantially disposed within the building and a second portion substantially disposed externally of the building. The valve retains water in the first water line portion in the event of a loss of water pressure in the second water line portion as may be caused, for example, by earthquake or other earth movement.

4 Claims, 1 Drawing Sheet

SYSTEM FOR PREVENTING LOSS OF WATER FROM THE WATER LINE OF A BUILDING

TECHNICAL FIELD

This invention relates to a system for preventing loss of water from the water line of a building when there is a break in the line external of the building or some other phenomenon which results in the decrease of water pressure externally of the building. A break in the line could, for example, occur in the event of an earthquake or other earth movement.

BACKGROUND ART

In the event of earth movement such as that caused by earthquake it is not at all uncommon to have the water line of a house or other building severed from the source of the building's water such as a water main or supply line. If there is a break, the water in the building's water line at that time will immediately begin to drain or siphon therefrom. Within a very short period of time the water line may be completely emptied.

Loss of water from a water line is not merely inconvenient but can create a serious and dangerous situation as well. Days may pass before water service is restored. The occupants of the building in such situations will find themselves without a convenient source of potable water. If water from other sources is available at all it may be unclean or contaminated. Illness or even death can result through use of such water. While people are encouraged to store potable water in containers for possible use in emergency situations it is an unfortunate fact that few persons actually do this.

DISCLOSURE OF INVENTION

The system of the present invention automatically provides for a supply of potable water within a building in the event such building is cut off from its normal outside source of water. According to the teachings of the present invention, the emergency supply of water is the water which is within the water line of the building itself at the time of the event causing interruption of normal water service.

The invention also serves to ensure that the water thus stored is maintained free of contaminates such as those which might enter the water system through a break whether it be above or below ground. The system of the present invention encompasses both a structural combination and a combination of method steps.

The structural combination includes a water line having a first water line portion substantially disposed within a building. The water line leads to a supply line and has a second water line portion substantially disposed externally of the building.

Valve means is provided for retaining water in the first water line portion in the event of loss of water pressure in the second water line portion. The valve means is connected to the water line and located at the juncture of the first water line portion and the second water line portion. The valve means is operable to permit the flow of water from the second water line portion to the first water line portion and to substantially prevent the flow of water from the first water line portion to the second water line portion.

A manually operable cut-off valve is operatively attached to the first water line portion adjacent to the valve means. The valve means and the manually operable cut-off valve are located externally of the building and adjacent thereto.

At least one relief valve is operatively associated with the first water line portion to relieve water pressure in the first water line portion when the valve means prevents the flow of water from the first water line portion to the second water line portion and after the water pressure in the first water line portion attains a predetermined magnitude. In the disclosed embodiment of the invention, the relief valve is located within the water closet of a toilet located in the building whereby water exiting the relief valve will be stored in the water closet.

Other features, advantages and objects of the present invention will become apparent with reference to the following description and the accompanying drawings.

BEST MODE FOR CARRYING OUT THE INVENTION

Figure 1:
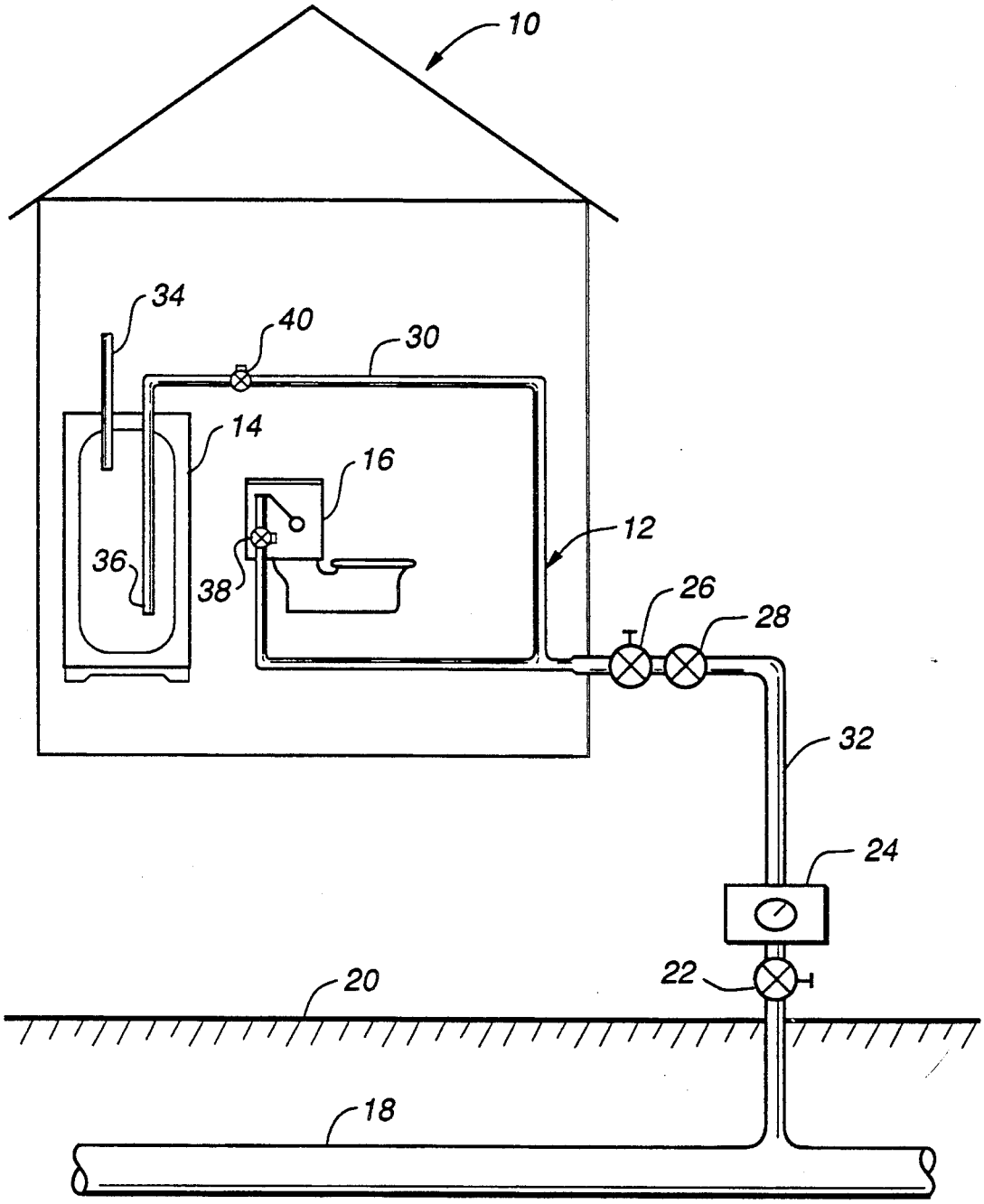
FIG. 1 is a diagrammatic side view of a building and a water system servicing the building modified in accordance with the teachings of the present invention.

Referring now to the drawing, a building, for example a house, is illustrated diagrammatically and generally designated by reference numeral 10. Disposed in building 10 is a portion of a water line 12. As is conventional, the water line 12 is operatively connected to various fixtures, appliances and articles such as a water heater 14 and a toilet 16.

Water line 12 leads from building 10 to a water supply line or main 18 disposed in the ground below ground level 20. As is conventional, the water line 12 may be equipped with a shut-off valve 22 and a water meter 24.

The illustrated arrangement also includes a manually operable cut-off valve 26 external of, and closely adjacent to, building 10.

In the system of the present invention, valve means in the form of a one-way check valve 28 is also located in water line 12. Check valve 28 is located between cut-off valve 26 and water main 18. Check valve 28 is so oriented as to permit the flow of water in a substantially unimpeded fashion from water main 18 to the building but to prevent the flow of water within water line 12 from the building 10 to the main.

One-way check valve 28 divides water line 12 into a first water line portion 30 substantially disposed within building 10 and a second water line portion 32 substantially disposed externally of the building.

One-way check valve 28 is for the purpose of retaining water in the first water line portion in the event of a loss of water pressure in the second water line portion. Such loss or drop in water pressure may occur, for example, due to complete or partial severance of the second water line portion or the main by earth movement such as that caused by an earthquake. Without the presence of check valve 28 in the system, a break of this nature would quickly drain the first water line portion 30 and the occupants of building 10 would lose an emergency supply of potable water. That is, without the existence of check valve 28, water would flow from first water line portion 30 to second water line portion 32.

The emergency supply of water may be used when needed by drawing on the contents of water line 12 at any desired location at first water line portion 30. For example, it is not at all uncommon for a cut-off valve such as cut-off valve 26 to be used in conjunction with a hose bib or faucet immediately adjacent to the building with which it is associated.

It will be appreciated that that portion of the water line 12 in building 10 is a closed system after closure of one or both of valves 26, 28. The water heater 14 is part of this closed system and the drawing illustrates the fact that a hot water outlet pipe 34 and a water inlet pipe 36, both of which may be considered part of water line 12, terminate in the interior of the fluid-tight water heater vessel. Heating of the water within water heater 14 will obviously expand the water therein and build up the pressure within first water line portion 30. If this pressure exceeds a certain predetermined level considerable damage can be caused. For this reason it is highly desirable to incorporate into the system of the present invention at least one relief valve to relieve water pressure in the first water line portion after it has been closed off from the second water line portion.

A preferred form of relief valve is a dual purpose anti-siphon ball cock and pressure relief valve assembly such as the Governor 80 dual purpose device made available by Watts Regulator of Lawrence, Massachusetts. Such as assembly is designated by reference numeral 38. In the event the pressure of the water within first water line portion 30 exceeds a predetermined temperature, some water from that portion will be bled from the assembly 38 into the confines of the water closet of toilet 16 with which the assembly is associated. Alternatively, or in conjunction with assembly 38, a water relief valve of any conventional type may be employed elsewhere in operative association with first water line portion 30. The drawing shows such alternative or auxiliary relief valve which is designated by reference numeral 40.

We claim:

1. Emergency water supply apparatus comprising, in combination:

a water line having a first water line portion substantially disposed within a building, said water line leading to a supply line and having a second water line portion disposed externally of said building;

valve means located externally of said building and closely adjacent thereto for retaining water in said first water line portion in the event of a loss of water pressure in said second water line portion, said valve means comprising a one-way check valve connected to said water line and located at the juncture external of said building of said first water line portion and said second water line portion and operable to permit the flow of water from said second water line portion to said first water line portion and to substantially prevent the flow of water from said first water line portion to said second water line portion whereby water in said first water line portion will provide an emergency supply of water for occupants of said building which may be accessed either internally or externally of said building; and at least one relief valve operatively associated with said first water line portion to relieve water pressure in said first water line portion when said valve means prevents the flow of water from said first water line portion to said second water line portion and after the water pressure in said first water line portion attains a predetermined magnitude.

2. The combination according to claim 1 additionally comprising a manually operable cut-off valve located externally of said building operatively attached to said first water line portion adjacent to said valve means between said building and said valve means.

3. The combination according to claim 1 wherein said at least one relief valve is located within the water closet of a toilet located in said building whereby water exiting said at least one relief valve will be stored in said water closet.

4. The combination according to claim 3 wherein said relief valve comprises a component of a dual purpose anti-siphon ball cock and pressure relief valve assembly.

* * * * *